US007600538B2

(12) United States Patent
Einarsson

(10) Patent No.: US 7,600,538 B2
(45) Date of Patent: Oct. 13, 2009

(54) SEAM FABRIC FOR A MACHINE FOR PRODUCING WEB MATERIAL, IN PARTICULAR PAPER OR PAPERBOARD

(75) Inventor: Johan Einarsson, Högsjö (SE)

(73) Assignee: Voith Patent GmbH, Heidenheim (DE)

( * ) Notice: Subject to any disclaimer, the term of this patent is extended or adjusted under 35 U.S.C. 154(b) by 24 days.

(21) Appl. No.: 11/934,921

(22) Filed: Nov. 5, 2007

(65) Prior Publication Data

US 2008/0283140 A1 Nov. 20, 2008

(30) Foreign Application Priority Data

Nov. 27, 2006 (DE) ..... 10 2006 055 824

(51) Int. Cl.

| | |
|---|---|
| ***D21F 7/10*** | (2006.01) |
| ***D21F 1/12*** | (2006.01) |
| *D21F 7/08* | (2006.01) |
| *D03D 25/00* | (2006.01) |

(52) U.S. Cl. ..... 139/383 AA; 139/383 A

(58) Field of Classification Search ..... 139/383 A, 139/383 AA

See application file for complete search history.

(56) References Cited

U.S. PATENT DOCUMENTS

| | | | | | |
|---|---|---|---|---|---|
| 4,026,331 | A | * | 5/1977 | Lees et al. | 139/383 A |
| 4,095,622 | A | * | 6/1978 | MacBean | 139/383 AA |
| 4,182,381 | A | * | 1/1980 | Gisbourne | 139/383 AA |
| 4,401,137 | A | * | 8/1983 | Cannon | 139/383 AA |
| 4,438,788 | A | * | 3/1984 | Harwood | 139/383 AA |
| 4,438,789 | A | * | 3/1984 | MacBean | 139/383 AA |
| 4,469,142 | A | * | 9/1984 | Harwood | 139/383 AA |
| 4,476,902 | A | * | 10/1984 | Westhead | 139/383 AA |
| 4,501,782 | A | * | 2/1985 | Weatherly et al. | 428/57 |
| 4,863,786 | A | * | 9/1989 | Green et al. | 442/241 |
| 4,896,702 | A | * | 1/1990 | Crook | 139/383 A |
| 5,089,324 | A | * | 2/1992 | Jackson | 442/195 |
| 5,092,373 | A | * | 3/1992 | Lee | 139/383 AA |
| 5,103,874 | A | * | 4/1992 | Lee | 139/383 A |
| 5,148,838 | A | * | 9/1992 | Lee | 139/383 AA |

(Continued)

FOREIGN PATENT DOCUMENTS

| | | |
|---|---|---|
| WO | WO00/09800 | 2/2000 |

*Primary Examiner*—Bobby H Muromoto, Jr.
(74) *Attorney, Agent, or Firm*—Taylor & Aust, P.C.

(57) ABSTRACT

Seam fabric for a machine for producing web material, in particular paper or paperboard, includes a basic structure constructed as seam cloth with weft threads running in a belt longitudinal direction and warp threads running in a belt transverse direction. At the belt longitudinal ends the weft threads form seam loops for joining the belt longitudinal ends. At least two weft thread layers are formed in the seam cloth, and weft thread pairs include respectively one weft thread of a first of the weft thread layers and one weft thread of a second of the weft thread layers. Two different types of groups of weft thread pairs are formed. In a first type of groups of weft thread pairs one respective weft thread of the first of the weft thread layers lies offset in a first direction in relation to the pair-wise assigned weft thread of the second of the weft thread layers. In the second type of groups of weft thread pairs one respective weft thread of the first of the weft thread layers lies offset in a second direction inverse to the first direction in relation to the pair-wise assigned weft thread of the second of the weft thread layers.

10 Claims, 2 Drawing Sheets

U.S. PATENT DOCUMENTS 5,188,884 A * 2/1993 Smith ..... 428/193
5,238,027 A * 8/1993 Lee ..... 139/383 AA
5,343,896 A * 9/1994 Schroder et al. ..... 139/383 A
5,411,062 A * 5/1995 Lee ..... 139/383 AA
5,544,678 A * 8/1996 Barrett ..... 139/383 A
5,601,120 A * 2/1997 Kuckart et al. ..... 139/383 AA
5,913,339 A * 6/1999 Lee ..... 139/383 AA
6,000,441 A * 12/1999 Lee et al. ..... 139/383 AA
6,079,454 A * 6/2000 Lee et al. ..... 139/383 AA
6,213,164 B1 * 4/2001 Ostermayer et al. ... 139/383 AA
6,267,150 B1 * 7/2001 Herring ..... 139/383 AA
6,431,221 B1 * 8/2002 Wrigley ..... 139/383 AA
7,059,358 B2 * 6/2006 Ogiwara ..... 139/383 A
7,141,144 B2 * 11/2006 Rydin ..... 162/358.2
2004/0159362 A1 * 8/2004 Ogiwara ..... 139/383 AA
2004/0182467 A1 * 9/2004 Gstrein ..... 139/383 AA
2004/0261883 A1 * 12/2004 Harrison ..... 139/383 A
2005/0252567 A1 * 11/2005 Yook et al. ..... 139/383 AA
2006/0249221 A1 * 11/2006 Lee ..... 139/383 AA

* cited by examiner

| S | K | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| | | | | | | | | | | | | | | | | | | |
| 1 | 1 | | 3 | | 5 | | 7 | 8 | 9 | | 11 | | 13 | | 15 | 16 | | 18 |
| 2 | 1 | 2 | 3 | 4 | 5 | | 7 | 8 | 9 | 10 | 11 | 12 | 13 | | 15 | 16 | 17 | 18 |
| 3 | | | 3 | | | | | | | | 11 | | | | | | | |
| 4 | | | 3 | | 5 | | 7 | | | | 11 | | 13 | | 15 | | 17 | |
| 5 | 1 | 2 | 3 | | 5 | | 7 | | 9 | 10 | 11 | | 13 | | 15 | | | 18 |
| 6 | 1 | 2 | 3 | | 5 | 6 | 7 | 8 | 9 | 10 | 11 | | 13 | 14 | 15 | 16 | 17 | 18 |
| 7 | | | | | 5 | | | | | | | | 13 | | | | | |
| 8 | 1 | | 3 | | 5 | | | | 9 | | 11 | | 13 | | | | 17 | |
| 9 | 1 | | 3 | | 5 | 6 | 7 | | 9 | | 11 | | 13 | 14 | 15 | | | 18 |
| 10 | 1 | 2 | 3 | 4 | 5 | 6 | 7 | | 9 | 10 | 11 | 12 | 13 | 14 | 15 | | 17 | 18 |
| 11 | 1 | | | | | | | | 9 | | | | | | | | | |
| 12 | 1 | | | | 5 | | 7 | | 9 | | | | 13 | | 15 | | 17 | |
| 13 | 1 | | 3 | 4 | 5 | | 7 | | 9 | | 11 | 12 | 13 | | 15 | | | 18 |
| 14 | 1 | | 3 | 4 | 5 | 6 | 7 | 8 | 9 | | 11 | 12 | 13 | 14 | 15 | 16 | 17 | 18 |
| 15 | | | | | | | 7 | | | | | | | | 15 | | | |
| 16 | 1 | | 3 | | | | 7 | | 9 | | 11 | | | | 15 | | 17 | |

SEAM FABRIC FOR A MACHINE FOR PRODUCING WEB MATERIAL, IN PARTICULAR PAPER OR PAPERBOARD

BACKGROUND OF THE INVENTION

1. Field of the Invention

This invention relates to a seam fabric for a machine for producing web material, in particular paper or paperboard.

2. Description of the Related Art

Seam fabrics for machines for producing web material, generally referred to also as needle felts, are often constructed with a basic structure formed as seam cloth. Such seam cloths are manufactured in an endless weaving process such that the weft threads of the seam cloth running in the belt longitudinal direction form seam loops at the two belt longitudinal ends. Said loops are joined together during the weaving operation by a seam thread or seam wire such that during the weaving operation the woven basic structure or the seam cloth actually has an endless configuration. For installation in a paper machine of the like, the two longitudinal ends are separated such that the belt can be pulled in its direction of movement into the machine, after which the two belt longitudinal ends can then be joined together again.

A tie pattern or an approach for weaving such a seam cloth as the basic structure for a seam fabric is presented in FIGS. 1 and 2. In FIG. 1 the lines 1 to 16 stand for the various weft insertions "S" running in the belt longitudinal direction while the columns 1 to 18 stand for the warp threads "K" running in the belt transverse direction. Shown is a weft/warp repeat, whereby the dark fields indicate warp elevations which form in each case during shedding. Shown in the upper part of FIG. 2 is the time-related run of the weft thread and weft insertions during the manufacturing of such a seam cloth. Also evident are two warp threads 10 and 12, of which the warp thread 10 forms the so-called lead thread and the warp thread 12 the so-called seam thread or seam wire. Between these two warp threads 10 and 12 there then lie the warp threads to be integrated in the weave, which are not shown any further. With this approach seam loops 14, 16 are formed in each case at the seam threads 12, namely in that for example first the weft 1 is inserted and forms the loop 14 over the seam thread 12 and then is returned as weft 2, namely through underneath the seam thread 12. The weft 2 then runs to the lead thread 10, is passed around it and then runs as weft 3 above the lead thread 10 always in the direction toward the other end of the weave in the weft direction. To form the seam loop 16 it is then passed first outside and then underneath around the seam thread 12 and moved back as weft 4 in the other direction toward the lead thread 10. In this way, two seam loops 14, 16 following one after the other in warp direction are formed. To form more seam loops this process is repeated in similar manner with a fifth weft whose run corresponds essentially to that of the first weft presented. The lower representations in FIG. 2 show in each case the height assignment of the two warp threads 10 and 12 in relation to the various weft insertions 1, 2, 3 and 4.

When such a seam cloth is completed and the seam thread 12 pulled out of the numerous seam loops 14 and 16 following one after the other in the warp direction, then a cloth with two longitudinal ends is obtained from the seam cloth which during the weaving operation was still an endlessly constructed seam cloth. This cloth includes two cloth sections 18, 20 between the longitudinal ends lying in the region of the seam loops 14 and 16, whereby the cloth section 18 is formed essentially with the wefts 1 and 2 and respectively following wefts, while the cloth section 20 is formed essentially with the wefts 3 and 4 and respectively following wefts. A cloth is thus provided in which the weft threads form two weft thread layers, whereby one of these weft thread layers includes essentially the wefts 1 and 4 and respective wefts, while another of these weft thread layers includes the wefts 2 and 3 and respective wefts. It is evident, therefore, that although in FIG. 2 the weft insertions with the numbers 1, 2, 3 and 4 follow one after the other in time and it is also possible as such for these weft insertions to be interpreted as respective weft threads during the weaving operation, when the seam thread 12 on the completed seam cloth is removed and the two longitudinal ends with the seam loops 14 and 16 respectively provided there are moved apart in order to create an elongated flat seam cloth, then the weft threads 1 and 4 and similarly the weft threads 2 and 3 actually continue each other and thus form in the completed and elongated flat cloth respectively a single weft thread provided with the two sections 1 and 4 and 2 and 3 respectively. Hence where talk in the following is of the weft threads 1, 2, 3 or 4, it refers respectively to, for example, the weft thread section 2 of the weft thread actually formed on the whole in the completed cloth by the weft insertions or weft thread sections 2 and 3.

FIGS. 3 and 4 show a cross-section of a seam fabric 22 constructed with such a seam cloth as the basic structure. For example, FIG. 3 shows a cross-section in the region of the cloth section 18, while FIG. 4 shows a cross-section in the region of the cloth section 20. From FIG. 3 it is evident first that such a constructed seam fabric 22 has fiber material 26 and 28 (represented only symbolically), for example felt material or fleece material, on the two sides of the basic structure 24, meaning the seam cloth. Also evident are the two layers 30, 32 of the weft threads 1, 2, whereby said weft thread layers 30, 32 form weft thread pairs 34 in which weft threads 1 and 2 are positioned essentially one above the other. It is also evident from FIG. 3 that, due to the time-related succession of the weft insertions, the wefts 1 to 2 of the respective weft thread pairs 34 do not lie exactly one above the other, which would be desirable, but have a lateral offset to each other, namely an offset in warp direction or in the belt transverse direction.

A corresponding offset also exists in the cloth section 20, which is shown in FIG. 4. On account of the manufacturing process, however, the offset between the wefts or weft thread sections 4 and 3 forming the weft thread layers 30 and 32 is inverse to the offset direction in the cloth section 18. Between these two cloth sections 18 and 20, namely where in the weaving process the weft threads are wound around the lead thread 10 and where the longitudinal ends, meaning the seam loops 14 and 16 are formed, there are in each of the weft thread pairs 34 crossover points in which the change of offset takes place.

When such a seam fabric 22, after being installed in a paper machine or the like, moves through press sections or a press nip, then because of the forces (indicated by arrows) acting on the surfaces of the seam fabric 22 the weft threads 1, 2 and 3, 4 of the respective weft thread pairs 34 are shifted more intensively in relation to each other, with the result that the entire weft thread layers 30 and 32 together with the respectively adjacent layers 26 and 28 shift sideways from the fiber material in relation to each other, meaning in the belt transverse direction. This results in particular in the thickness of the seam cloth or the basic structure being reduced slightly. Only where the individual weft threads of the weft thread pairs 34 cross over each other is the thickness somewhat greater. As previously explained, said crossover points exist at defined positions of the belt looking in the belt longitudinal direction, hence essentially all these crossover points of the various weft thread pairs run through a press nip simultaneously. As the result, the devices exerting pressure on the seam fabric 22, meaning for example the press rollers, are pushed slightly apart, whereby the pushing apart occurs twice on each complete belt pass. This leads to a so-called roller oscillation, which has a negative effect on the performance of a paper production operation and also leads in particular to an impairment of the quality of the produced web material, meaning paper.

What is needed in the art is a seam fabric for a machine for producing web material, with which the occurrence of roller oscillations can be avoided.

SUMMARY OF THE INVENTION

The present invention provides a seam fabric for a machine for producing web material, in particular paper or paperboard, including a basic structure constructed as seam cloth with weft threads running in a belt longitudinal direction and warp threads running in a belt transverse direction. At the belt longitudinal ends the weft threads form seam loops for joining the belt longitudinal ends. At least two weft thread layers are formed in the seam cloth, and weft thread pairs include respectively one weft thread of a first of the weft thread layers and one weft thread of a second of the weft thread layers. Two different types of groups of weft thread pairs are formed. In a first type of groups of weft thread pairs one respective weft thread of the first of the weft thread layers lies offset in a first direction in relation to the pair-wise assigned weft thread of the second of the weft thread layers. In the second type of groups of weft thread pairs one respective weft thread of the first of the weft thread layers lies offset in a second direction inverse to the first direction in relation to the pair-wise assigned weft thread of the second of the weft thread layers.

On the inventively constructed seam fabric, not all weft threads in the respective weft thread pairs are offset in the same direction in relation to each other. Through this partly inverse offset, a pressure-induced uniform shifting of two weft thread layers is largely prevented with the result that the crossover points inevitably arising on such seam fabrics are not as prominent as is the case on conventional seam fabrics. Consequently, when these crossover points move through between press rollers or the like, a shifting of the press rollers or the like due to an increase of thickness in the region of the crossover points can be largely avoided.

The inventive seam fabric can have at least one group of the first type and at least one group of the second type.

The stabilization of the weft thread layers in relation to each other by the inventively incorporated offset in different directions can be intensified if groups of the first type change in alternation with groups of the second type in the weft direction.

To be able to obtain a symmetrical construction with a uniform distribution of the respective offset fractions it is proposed for the groups of the first type and the groups of the second type to include essentially an equal number of weft thread pairs. For example it is possible to provide for the groups of the first type and/or the groups of the second type to include four weft thread pairs.

The first of the weft thread layers can form a web-material-side weft thread layer and the second of the weft thread layers can form a running-side weft thread layer.

The inventive seam cloth can be constructed with two weft thread layers. In principle, however, it is also possible for there to be more than two weft thread layers, wherein there can be for example an intermediate weft thread layer between a web-material-side weft thread layer and a running-side weft thread layer. The inventively provided offset can then be related to the weft threads lying directly one below the other in the thickness direction, for example the weft threads of the web-material-side weft thread layer and the intermediate weft thread layer or of the intermediate web thread layer and the running-side weft thread layer. Of course such an offset can also be related to a respective weft thread pair which includes a weft thread of the running-side weft thread layer and a weft thread of the web-material-side weft thread layer. Between the latter it is possible for another weft thread of the intermediate weft thread layer to be positioned.

Above all when an inventively constructed seam fabric is to be used in a drying section or a press section of a machine for producing web material it is advantageous for fiber material, such as fleece material or felt material, to be provided at least on one side of the basic structure.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 5:
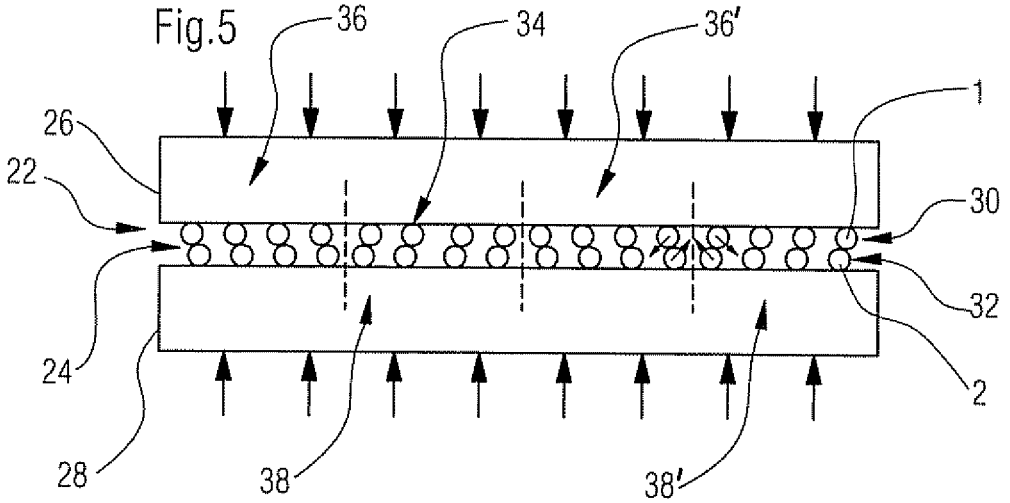
FIG. 5 is shows a cross-sectional view of an inventively constructed seam fabric.

Referring now to the drawings, and more particularly to FIG. 5, there is shown an inventive seam fabric 22 shown in cross section. Said fabric has in its central region a seam cloth as basic structure 24, on both sides of which there is a fiber material such as felt material or fleece material 26, 28 fixed by pinning for example. Also the inventive seam fabric 22 has two weft thread layers 30, 32, wherein for example the weft thread layer 30 is a web-material-side weft thread layer such that during the production process the fiber material 26 comes into contact with the web material to be produced, for example paper. The weft thread layer 32 is then a running-side weft thread layer such that the fiber material 28 comes into contact with various rollers which guide, drive or divert the seam fabric 22.

Figure 3:
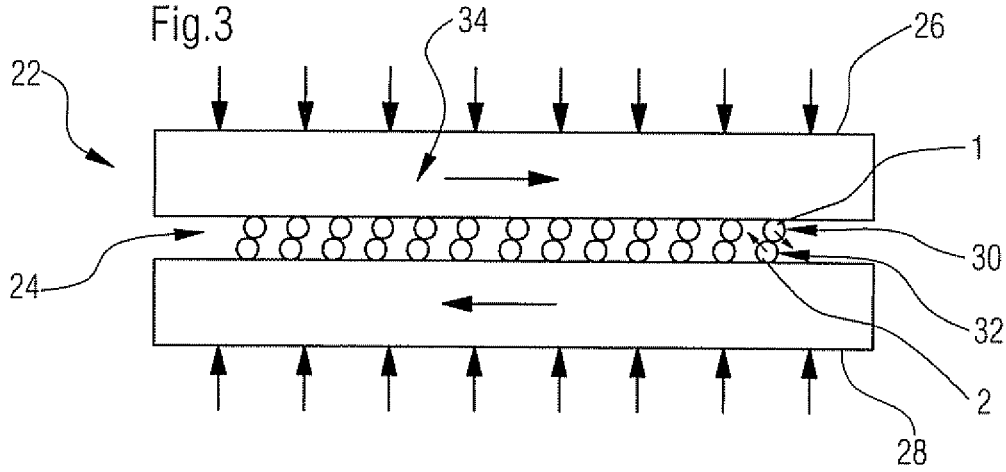
PRIOR ART Fig.3
FIG. 3 is shows a schematic cross-sectional view of a seam fabric.
Figure 4:
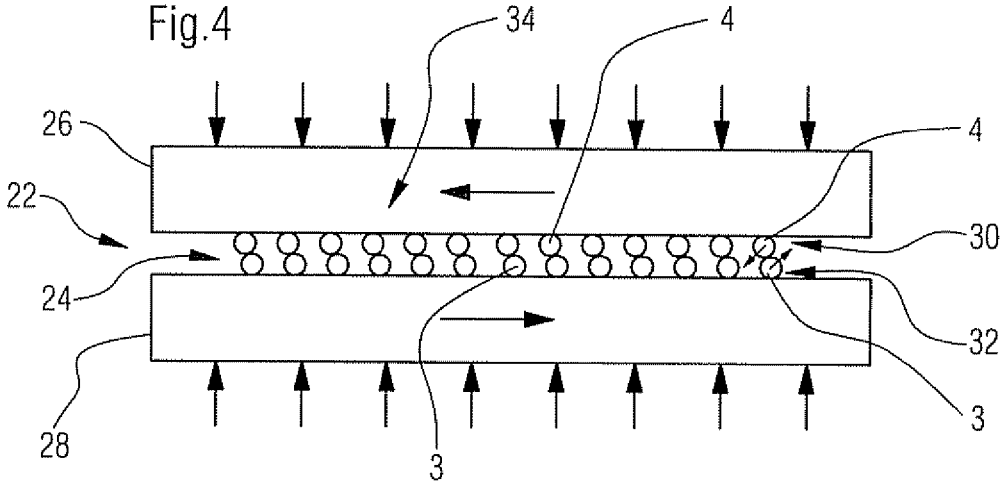
PRIOR ART Fig.4
FIG. 4 is shows a cross-sectional view corresponding to FIG. 3, sectioned at a different longitudinal position of a seam fabric.

On the weft thread layers 30, 32, weft threads 1, 2, which lie directly one above the other, of the two weft thread layers 30, 32 (and accordingly also weft threads 4, 3 when presenting a section in another longitudinal region) form weft thread pairs 34. It is evident in FIG. 5 from the vertical dashed lines that there are four groups 36, 38, 36' and 38' of weft thread pairs 34, wherein in principle two different types of groups of weft thread pairs 34 can be recognized here. The groups 36 and 36' are to be assigned to a first type of groups of weft thread pairs 34 while the groups 38 and 38' are to be assigned to a second type of groups of weft thread pairs 34. It is evident that these two types, 36, 36' on the one hand and 38, 38' on the other hand, differ in that the offset of the singly or pair-wise assigned weft threads of the respective weft thread pairs is aligned exactly inverse. Hence when in the groups 36 and 36' the weft thread 1 of the web-material-side weft thread layer 30 in the representation in FIG. 5 is shifted to the left in relation to the pair-wise assigned weft thread 2 of the running-side weft thread layer 32, namely to the left edge of the seam fabric 22, then in the groups 38, 38' said weft thread 1 of the web-material-side weft thread layer 30 is shifted to the right edge of the seam fabric 22 in relation to the pair-wise assigned weft thread 2 of the running-side weft thread layer 32. Through this inverse offset and due to the fact that of each type of groups of weft thread pairs 34 there is at least one group 36, 36' on the one hand and 38, 38' on the other hand in the seam fabric 22, the forces which arise under load and try to move the two weft thread layers 30, 32 sideways in relation to each other and shift even further the weft threads 1, 2 assigned pair-wise to each other are compensated. Of course, account must be taken of the fact that the various weft threads 1, 2 and 3 and 4 are woven with warp threads (not shown in the figures), through which transverse forces are transmitted between the weft threads, which run side by side, of the respective weft thread layers. Because it is impossible on the thus constructed seam fabric 22 for a defined relative shift of the two weft thread layers 30, 32 to occur during compression as is the case on the embodiment according to FIGS. 3 and 4, the weft threads 1 and 2 and 3 and 4 respectively of the weft thread layers 30 and 32 retain essentially their relative position so that even where the inevitable production-induced crossover points at the respective longitudinal ends exist, meaning in the region of the seam loops 14 and 16 and in the longitudinal center region of the seam fabric 22, there is no essential thickening of the seam cloth or the basic structure 24. Hence during passage between rollers which exert a load on such a seam fabric 22, the generation of a periodic force which presses these rollers apart is avoided.

The stabilization is intensified further when of the groups of weft thread pairs 34 there are several of each on the inventively constructed seam fabric and they change with each in alternation. Also, the uniform number of weft thread pairs 34 in the various groups 36, 38, 36' and 38' contribute to a harmonization of the arising forces.

Figures 1, 2:
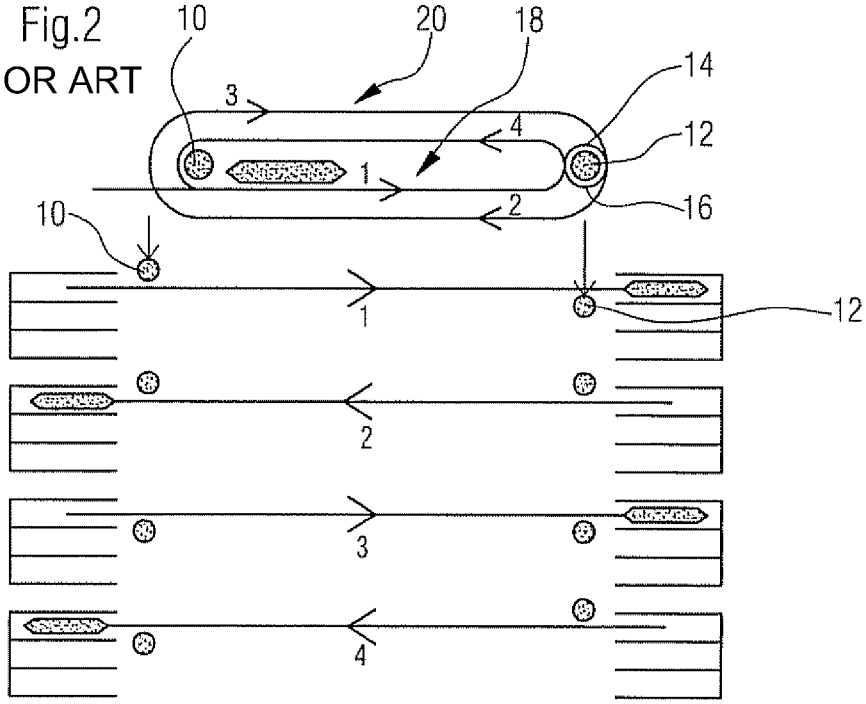
PRIOR ART Fig.1
Fig.2 PRIOR ART
FIG. 1 is shows a tie pattern for a seam cloth of a seam fabric.
FIG. 2 is shows a weft thread cycle for forming two seam loops in a seam cloth.

A seam cloth or a basic structure with the relative position of the weft threads of the various weft thread pairs 34 evident in FIG. 5 can be obtained for example if, starting from a standard tie pattern as shown in FIG. 1, the order of the tie patterns formed with the respective weft insertions is reversed in relation to the warp threads. Let us assume, for example, that the standard order of the weft insertions is defined as follows:

| | | | | |
|---|---|---|---|---|
| Standard: | 1, 2, 3, 4 | 5, 6, 7, 8 | 9, 10, 11, 12 | 13, 14, 15, 16 |

From the work scheme in FIG. 2 it is clear that in each case four consecutive weft thread insertions form one weft thread pair 34 of weft threads one above the other after removal of the seam thread 12. If with this standard order the weft inserts 1, 2, 3 and 4 are considered, for example, then from FIG. 2 it is evident that in the first cloth section 18 the weft threads or weft insertions 1 and 2 lie one above the other while in the second cloth section 20 the weft threads 3 and 4 then lie one above the other and thus define the same weft thread pair 34. Through this standard order of weft insertions, wherein for example the warp elevations evident in FIG. 1 are assigned to each weft insertion, four weft thread pairs 34 are thus defined with sixteen weft insertions so that when using for example this standard order of weft insertions the groups 36 and 36', meaning the first type of groups of weft thread pairs 34, can be formed.

If, proceeding from this standard order for the weft thread insertions forming respectively one weft thread pair, the order is reversed, this will result for example in the following:

| | | | | |
|---|---|---|---|---|
| Conversely: | 4, 3, 2, 1 | 8, 7, 6, 5 | 12, 11, 10, 9 | 16, 15, 14, 13 |

This reversed order with its 16 weft insertions thus defines four weft thread pairs 34 in the seam cloth 24, wherein due to the reversal of the order the offset of the weft threads 1, 2 and 3, 4 of a respective weft thread pair 34 also changes. Through this reversed order it is possible to create in each case one group 38 or 38' of the second type of groups of weft thread pairs 34. Each change between the standard order and the reversed order thus means a change between a group of the first type and a group of the second type. If only a single such change occurs in a seam cloth 24, for example in the center of the width, then one half of the seam cloth would be constructed with offset in the one direction and the other half would be constructed with offset in the other direction. The frequency of the change between these orders, meaning the change between the various types of groups, can be selected in the light of the loads and requirements arising during production of the web material. It goes without saying that a change of order does not have to occur necessarily after each repeat. Changing is also possible within a repeat or the change pattern can be larger than the repeat pattern.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1, 2, 3, 4 Weft threads
12 Seam thread
14, 16 Seam loops
20 Seam fabric
24 Basic structure
26, 28 Fiber material
30, 32 Weft thread layers
34 Weft thread pairs
36, 36', 38, 38' Groups

What is claimed is:

1. A seam fabric for a machine for producing a web of fibrous material, said seam fabric comprising:

a basic structure configured for forming at least part of a belt having a plurality of belt longitudinal ends, said basic structure being formed as a seam cloth including a plurality of weft threads running in a belt longitudinal direction and a plurality of warp threads running in a belt transverse direction, said plurality of weft threads forming a plurality of seam loops, at least two weft thread layers, and a plurality of weft thread pairs, said plurality of seam loops being at said plurality of belt longitudinal ends and being configured for joining said plurality of belt longitudinal ends, said at least two weft thread layers including a first weft thread layer and a second weft thread layer, said plurality of weft thread pairs each including respectively one weft thread of said first weft thread layer and one weft thread of said second weft thread layer such that said one weft thread is a pair-wise assigned weft thread of said second weft layer, said plurality of weft thread pairs forming a plurality of groups of weft thread pairs including a first type of group and a second type of group which is different from said first type of group, in said first type of group of weft thread pairs one respective weft thread of said first weft thread layer lying offset in a first direction in relation to a respective said pair-wise assigned weft thread of said second weft thread layer when viewing said wefts of said first type of group in cross-section taken in said transverse direction, in said second type of group of weft thread pairs one respective weft thread of said first weft thread layer lying offset in a second direction inverse to said first direction in relation to a respective said pair-wise assigned weft thread of said second weft thread layer when viewing said wefts of said second type of group in cross-section taken in said transverse direction.

2. The seam fabric according to claim 1, wherein said first type of group of weft thread pairs includes at least one group of said first type of group and said second type of group of weft thread pairs includes at least one group of said second type of group.

3. The seam fabric according to claim 1, wherein said first type of group of weft thread pairs includes a plurality of groups and said second type of group of weft thread pairs includes a plurality of groups, said plurality of groups of said first type of group changing in alternation with said plurality of groups of said second type in a weft direction.

4. The seam fabric according to claim 1, wherein said first type of group of weft thread pairs includes a plurality of groups and said second type of group of weft thread pairs includes a plurality of groups, said plurality of groups of said first type of group changing in alternation with said plurality of groups of said second type in a warp direction.

5. The seam fabric according to claim 1, wherein said first type of group of weft thread pairs includes a plurality of groups and said second type of group of weft thread pairs includes a plurality of groups, said plurality of groups of said first type of group and said plurality of groups of said second type of group including essentially a same number of weft thread pairs.

6. The seam fabric according to claim 1, wherein said first type of group of weft thread pairs includes a plurality of groups and said second type of group of weft thread pairs includes a plurality of groups, at least one of said plurality of groups of said first type of group and said plurality of groups of said second type of group including four weft thread pairs.

7. The seam fabric according to claim 1, wherein said first weft thread layer forms a web-material-side weft thread layer and said second weft thread layer forms a running-side weft thread layer.

8. The seam fabric according to claim 1, wherein said seam cloth is formed with two weft thread layers.

9. The seam fabric according to claim 1, further comprising a fiber material on at least one side of said basic structure.

10. The seam fabric according to claim 9, wherein said fiber material is one of a fleece material and a felt material.

* * * * *